United States Patent [19]

deBoer

[11] 4,242,825

[45] Jan. 6, 1981

[54] FIREARM MECHANISM

[75] Inventor: Fred L. deBoer, Honolulu, Hi.

[73] Assignee: Sherry Miles deBoer, Walnut Creek, Calif.

[21] Appl. No.: 16,011

[22] Filed: Feb. 28, 1979

[51] Int. Cl.[3] ..... F41C 27/00

[52] U.S. Cl. ..... 42/1 R; 42/17; 42/40; 42/70 R; 42/76 R

[58] Field of Search ..... 42/70 R, 76 R, 40, 1 R, 42/17, 1 D

[56] References Cited

U.S. PATENT DOCUMENTS

| | | | |
|---|---|---|---|
| 385,360 | 7/1888 | Lefever | 42/40 |
| 890,186 | 6/1908 | Singer | 42/40 |
| 2,952,933 | 9/1960 | Stevens | 42/1 R |
| 3,237,335 | 3/1966 | Kerr | 42/70 R |
| 3,990,169 | 11/1976 | Jennie et al. | 42/1 R |
| 4,098,016 | 7/1978 | Foote | 42/16 |

*Primary Examiner*—Charles T. Jordan

*Attorney, Agent, or Firm*—Limbach, Limbach & Sutton

[57] ABSTRACT

This invention relates to safety devices for shotguns preventing wrong sized cartridges from lodging in shotgun barrels.

5 Claims, 7 Drawing Figures

FIREARM MECHANISM

BACKGROUND OF INVENTION

It has been known for many years that a substantial danger exists in the operation of firearms and particularly shotguns where a small diameter cartridge can become lodged in the barrel of a gun designed to handle larger diameter cartridges. This is particularly a problem where the user of a given collection of firearms has certain standard diameter cartridges for a smaller firearm which may become lodged in the barrel of a larger diameter firearm.

For instance, the owner of 12 and 20 gauge shotguns may accidentally insert a 20 gauge cartridge in the 12 gauge shotgun. The 20 gauge cartridge is small enough to pass through the ignition chamber of a 12 gauge shotgun, but large enough that it will lodge in the barrel of the shotgun and not pass all the way through. Instances have occurred where a 12 gauge shotgun barrel is blocked in this way and a 12 gauge cartridge is subsequently discharged into the blocked barrel with disastrous results.

The problem occurs with many different sized cartridges, but it is particularly serious with 12 and 20 gauge shotguns because many shooters prefer to use 20 gauge shotguns for skeet shooting and 12 gauge shotguns for hunting.

It is an object of this invention to prevent a shotgun barrel from becoming blocked with a cartridge which is smaller in diameter than the size cartridge for which the barrel is designed.

SUMMARY OF INVENTION

In accordance with this invention, firearms can be protected from blockage by subcaliber cartridges. The firearms of this invention have an otherwise conventional barrel with a discharge end and an ignition chamber remote from the discharge end. The ignition chamber has a predetermined diameter designed to receive a cartridge of substantially the same predetermined diameter, for instance, a 12 gauge shotgun cartridge.

The firearm barrel further has a minimum diameter which is less than the predetermined diameter of the chamber. The minimum diameter is generally at the discharge end of the barrel where the barrel has a modified or full choke for instance, but the minimum diameter of the barrel may be located a substantial distance away from the discharge end.

In accordance with this invention the firearm is provided with means for excluding from the portion of the barrel outside the chamber all cartridges having diameters which are less than the predetermined diameter and greater than the minimum diameter. Shotguns are provided in accordance with my invention in a variety of known configurations. For instance, my invention may be used in otherwise conventional breech loading shotguns of the pivot breech type and also in gas automatic and pump operated shotguns which are fed from a magazine.

The shotguns of my invention may be constructed in two generally different ways. On the one hand, a mechanism may be provided for detecting the diameter of a cartridge and locking the cartridge out of the firearm if it is too small. On the other hand, a retainer mechanism may be provided adjacent to the ignition chamber for retaining in the ignition chamber undersized cartridges. In the latter case the undersized cartridges may be retained in the ignition chamber in either an operative position or in a position where it will detonate, but in either event the subcaliber cartridge which is retained does not detonate into a blocked barrel.

The forms of my invention retaining a subcaliber cartridge in the chamber are particularly well adapted to the pivoted breech loading shotguns, whereas, the first form of the invention, excluding subcaliber cartridges from the firearm, is particularly well adapted to the gas operated automatic and pump operated magazine shotguns, though a particular firearm may be constructed with both types of the invention.

Where a shotgun is made in accordance with this invention with a mechanism for preventing the insertion of a subcaliber cartridge into the chamber, it is preferable to employ a cartridge operated latch in the feeding train from the shooter's hand to the magazine and hence to the chamber, and the latch may operate either to prevent movement from the shooter's hand into the magazine or to prevent movement from the magazine to the chamber. In either event, the latch is preferably designed to detect the diameter of the cartridge and to unlatch only if the cartridge is big enough to be a cartridge for which the firearm is designed.

These and other features of the invention will become apparent from a description of the following embodiments of the invention which are described in connection with conventional type pivoted breech double barrel and magazine loading shotguns.

Figure 1:
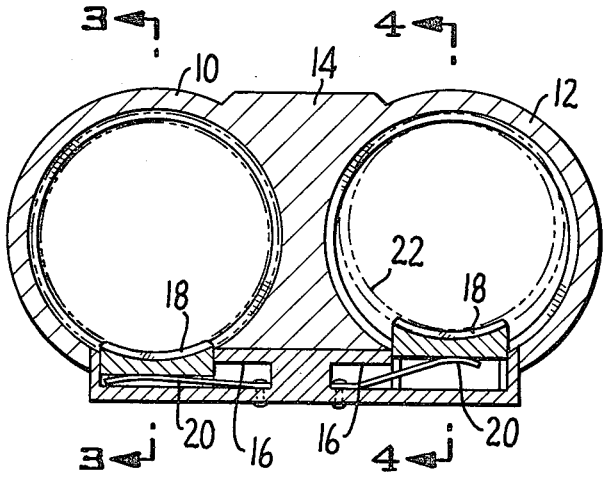
FIG. 1 is a cross-sectional view of a pivoted breech double barrel shotgun constructed in accordance with this invention.

Referring now in detail to the drawings, the shotgun in FIG. 1 includes a pair of barrels 10 and 12 connected by a web 14. The barrels may be provided with a variety of other well-known devices, such as ejectors, ventilated ribs and the like. A pair of recesses 16 are provided in the base of the web 14 holding a pair of blades 18 supported on springs 20. In the absence of any cartridge the spring 20 supports the blade 18 protruding into the chamber of the firearm by a sufficient distance that the blade engages and holds any cartridge which is smaller than the minimum diameter of the barrel. In other words, the circle indicated by numeral 22 in FIG. 1 and FIG. 4 has a diameter at least as small as the minimum diameter of the barrel defined by the forward throat of the chamber and the maximum choke of any fixed choke or variable choke on the barrel.

Figure 3:
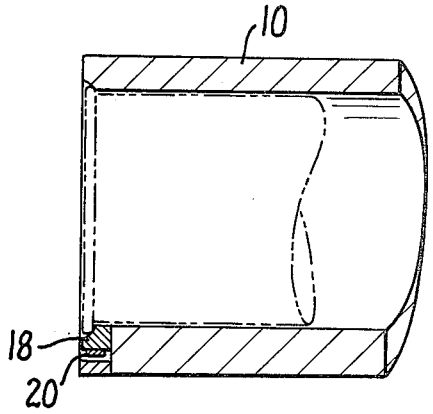
FIG. 3 is a longitudinal sectional view of one of the barrels of FIG. 1 containing a proper diameter cartridge.
Figure 2:
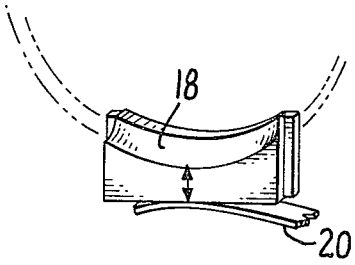
FIG. 2 is a perspective view of the spring loaded retainer member of FIG. 1.
Figure 5:
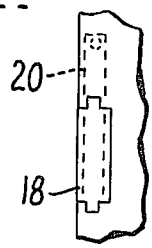
FIG. 5 is a view taken along the line 5—5 in FIG. 4.
Figure 4:
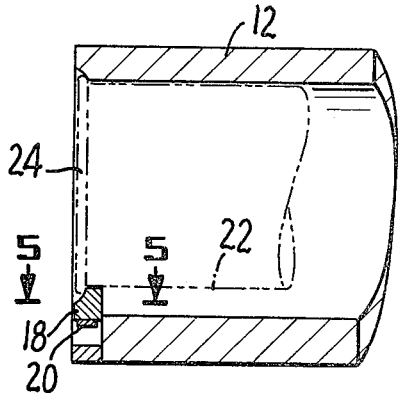
FIG. 4 is a longitudinal sectional view of one of the barrels of the firearm of FIG. 1 containing a subcaliber cartridge.

The operation of the apparatus of FIGS. 1–5 will be apparent from the drawings. When a subcaliber cartridge is inserted in the chamber as illustrated in FIG. 4, the blade 18 engages the rim 24 of the cartridge and retains the cartridge in the chamber. When a proper diameter cartridge is inserted in the chamber as illustrated in FIG. 3, the blade 18 is merely pushed aside against the resiliency of spring 20 to permit normal operation of the firearm.

Referring to FIGS. 6–9, the firearm illustrated therein is an otherwise conventional type of magazine loading firearm containing a barrel 26, a magazine 28 and a frame 30. A pivoted lever 32 is mounted in the frame 30 by means of a pivot pin 34. This pivoted lever may be a conventional lever used in a magazine feeding mechanism for alternately diverting cartridges into the magazine from the shooter or into the chamber from the magazine. In accordance with this invention a pair of resilient latch fingers 36 are mounted in the frame 30 by pins 38 with the fingers supported in recesses 40, and the fingers carry a pair of latch shoulders 42 which engage and lock the lever 32 in a lower blocking position shown in full line in FIG. 8 and blocking the passage of a cartridge from the shooter into the magazine. A pair of lobes 44 are provided on the lower ends of the fingers 36 with the inner edges of the lobes 44 spaced apart by a distance substantially equal to the diameter of a cartridge for which the firearm is designed when the latch shoulders 42 are unlatched.

Figure 6:
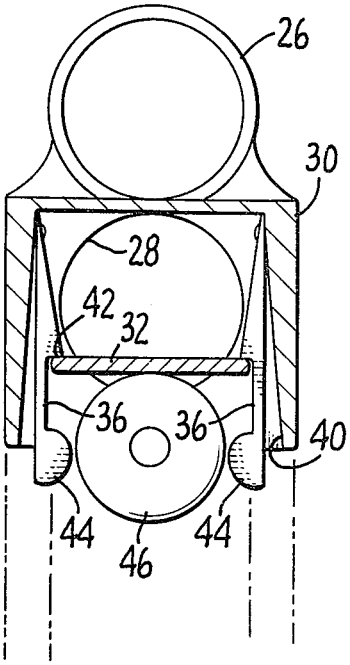
FIG. 6 is a cross-sectional view through a magazine loading single barrel firearm constructed in accordance with the principles of this invention showing the apparatus in a locked condition excluding a subcaliber cartridge.
Figure 7:
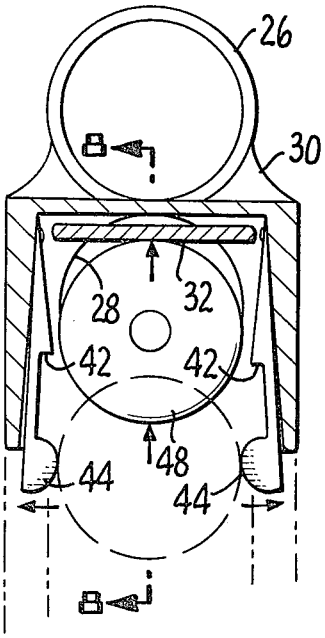
FIG. 7 is a view similar to FIG. 6 showing the apparatus in an unlocked condition for insertion of a proper diameter cartridge.
Figure 8:
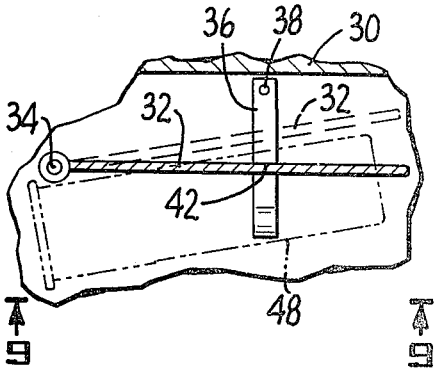
FIG. 8 is a cross-sectional view taken along the plane indicated at 8—8 in FIG. 7.
Figure 9:
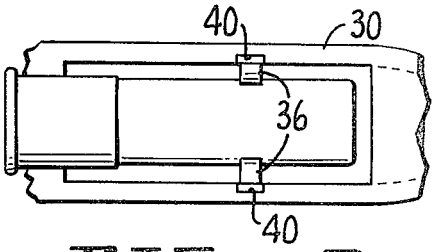
FIG. 9 is a cross-sectional view taken along the plane indicated at 9—9 in FIG. 8.

The operation of the firearm of FIGS. 6–9 will be apparent from the drawings. When the shooter attempts to insert a subcaliber cartridge 46 into the firearm as illustrated in FIG. 6, the cartridge will engage the lever 32 but the shooter is unable to further insert the cartridge into the firearm because the spring fingers 36 lock the lever 32 in the blocking position. On the other hand, when the shooter attempts to insert a proper caliber cartridge 48 into the firearm as shown in FIG. 7, the periphery of the cartridge engages the lobes 44 to spread the fingers 36 apart and unlatch the latch surface 42 so that the lever 32 may swing upwardly to an open or cartridge feeding position shown in phantom outline in FIG. 8 where the cartridge may be fed into the magazine.

While certain specific embodiments of my invention have been illustrated and described in detail herein, it is obvious that many modifications thereof may be made without departing from the spirit and scope of my invention as defined by the following claims.

I claim:

1. A firearm comprising a barrel having a discharge end, an ignition chamber in said barrel remote from the discharge end for supporting a cartridge during ignition with the ignition chamber having a predetermined diameter for receiving a cartridge of substantially said predetermined diameter, said barrel having a minimum diameter less than the predetermined diameter, and means forming a permanent part of the firearm for excluding from the portion of the barrel outside of the chamber cartridges having diameters which are less than the predetermined diameter and greater than the minimum diameter.

2. The firearm of claim 1 in which the excluding means comprises means for preventing a cartridge with a diameter smaller than the predetermined diameter from being inserted in the chamber.

3. The firearm of claim 1 in which the excluding means comprises means for retaining in the chamber cartridges having diameters greater than the minimum diameter.

4. The firearm of claim 2 in which said excluding means comprises a lever movable between a feeding position for feeding a cartridge into the firearm and a blocking position, latching means for locking the lever in the blocking position, and means for unlatching the latching means in response to the insertion of a cartridge of said predetermined diameter into the firearm.

5. The firearm of claim 3 in which the excluding means comprises a spring mounted blade at the entrance to the chamber position to engage all cartridges larger than the minimum diameter and movable outwardly of the chamber to the predetermined diameter.

* * * * *